United States Patent [19]

Curry, Sr.

[11] Patent Number: 5,000,712

[45] Date of Patent: Mar. 19, 1991

[54] RIDING TOY

[76] Inventor: John L. Curry, Sr., 111 Eagle Creek, Collinsville, Ill. 62234

[21] Appl. No.: 472,031

[22] Filed: Jan. 30, 1990

[51] Int. Cl.[5] ..... A63H 33/00

[52] U.S. Cl. ..... 446/26; 272/1 D

[58] Field of Search ..... 272/1 D, 52, 52.3; 54/44; 446/26

[56] References Cited

U.S. PATENT DOCUMENTS

| | | | |
|---|---|---|---|
| D. 159,705 | 8/1950 | Whitney | 272/52 X |
| 2,585,279 | 2/1952 | Sickelbower | 272/10 |
| 2,659,600 | 11/1953 | Becker | 272/1 D |
| 2,707,102 | 4/1955 | Wendt | 272/1 D |
| 3,224,762 | 12/1965 | Strader | 272/1 D |
| 3,920,239 | 3/1975 | White | 272/1 D |
| 4,333,642 | 6/1982 | Adams | 272/1 D |
| 4,608,811 | 9/1986 | Echeverri | 54/44 |

OTHER PUBLICATIONS

Danoco Corporation, Knee Rider toy as discussed on pp. 3, 4 and 5 of Applicant's present application. Photographs of actual device and copies of pertinent portions of the accompanying literature are attached herewith.

*Primary Examiner*—Richard E. Chilcot, Jr.
*Attorney, Agent, or Firm*—Haverstock, Garrett & Roberts

[57] ABSTRACT

A child's riding toy fashioned to simulate the appearance of an animal or other character such as a horse and attachable to the upper leg portion of person comprising a body member having spaced apart top and bottom surfaces, the body member being formed of a compressible type material and having a lower surface conformable to the upper leg portion of a person when attached thereto, the upper surface of the body member having a seat or saddle like shaped area associated therewith adapted to receive the posterior of a child when seated thereon, and a strap arrangement associated with the bottom portion of the body member for attaching the toy to the upper leg portion of a person. The body member is sized and shaped so as to have sufficient padding or other material between the top and bottom surfaces so as to provide some cushioning effect for a child seated thereon. Also, the strap arrangement is preferably adjustable to accommodate attachment to leg portions having different circumferential dimensions. When fashioned to simulate the appearance of a horse, the present toy may also include a bridle assembly with reins, stirrups extending from opposite sides of the body member for accommodating the feet of a child positioned thereon, and a saddle blanket which overlays and overhangs the opposite sides of the leg upon which it is positioned.

17 Claims, 2 Drawing Sheets

RIDING TOY

The present invention relates generally to a riding type toy and, more particularly, to a toy specifically designed to be positioned on and secured to the leg of an adult, the present toy including means for enabling a child to sit thereon in a riding position so as to play and interact with the adult on whose leg the toy is positioned. The present toy is shaped and configured so as to resemble a riding type animal such as a pony or the like and includes head and neck portions and a body portion, the various toy portions being made of a soft, compressible, resilient and/or flexible type material providing at least some cushioning means for the body portion and at least some limited yieldability or flexibility for the neck and head portions. The body portion of the present toy also includes a portion shaped to receive the posterior of a child on which the child sits and strap means for securing the toy to a person's leg. Handle means associated with the head and neck portion are also provided for grasping by a child to help the child maintain proper position on the toy during use thereof. For realistic simulation and effect, the head and neck portion of the present toy may include a mane fabricated of fibrous strands of material and appropriate facial features depending upon the particular animal form after which the toy is fashioned and the head and neck portions may be constructed so as to be somewhat pliable and movable thereby allowing some degree of manipulation to simulate head and neck movement. In this regard, although it is recognized that the present toy can be made to simulate a wide variety of animals such as a horse, giraffe, camel, zebra, elephant, dinosaur or other animal character, a toy fashioned to simulate the appearance of a pony will be described hereinafter for ease of discussion and explanation.

BACKGROUND OF THE INVENTION

Different kinds of toys in which a horse, pony or various other animal forms and characters are reproduced for use by children to simulate the riding of such animals, such as horseback riding, are well known in the art. Typical of such known riding type animal toys are those patterned somewhat after the familiar broom or stick-type pony which normally includes a member simulating a pony's head mounted on a stick or main frame member contoured so as to be adaptable for riding by holding and extending the main body of the horse between the legs of the rider. Other known constructions include the conventional hobby horse wherein a child sits on a horse figure which is suspended from a frame structure by a plurality of springs or other biasing means to simulate horseback riding, and the well known rocking horse wherein a horse or pony figure mounted on a rocking base moves back and forth as the child shifts its weight on the device, again to simulate the riding experience. The prior art devices also teach a wide variety of toy animal constructions adaptable to be worn about the waist and/or supported from the shoulders. Typical of such constructions are those which include a shell type structure molded or shaped to simulate the torso of a horse or other similar animal character having an opening therein whereby the shell structure fits about the body of the child and is supportable therearound by shoulder straps, suspenders or other means adapted to engage and cling to the body of the child interposed therewithin. In these particular known embodiments, the child wears the toy while running or walking thereby simulating the movements of riding horseback. See for typical examples the constructions shown in U.S. Pat. Nos. 4,333,642; 3,920,239; 3,224,762; 2,707,102 and 2,659,600. While the prior art devices set forth above and other similar toys disclose animal riding toys, these toys require that the child be able to walk or run and have established playing skills and imagination. Additionally, because these toys require walking, running or the ability to sit on the animal figure without the aid or support of a person located close by, these devices do not provide a toy readily adaptable for constructive interaction with adults and, futhermore, such devices are not generally designed or adaptable for use by very small children.

Riding toys that provide interaction with an adult are also known in the art. For example, Echeverri U.S. Pat. No. 4,608,811, discloses a miniaturized toy saddle shaped to hold and carry a young child, the saddle being specifically designed to be strapped onto the back of an adult while such adult crawls or otherwise moves across the floor or ground. An obvious limitation associated with a toy such as that described in Echeverri is that if the child is on the adult's back, there is no face-to-face contact between adult and child. Without face-to-face contact, or at least having the child positioned in front of the adult, the adult is not able to effectively take part in the child's play. Additionally, the physical stress and general undesirableness of crawling on one's hands and knees likewise serves to shorten the period of play and interaction between adult and child.

Another toy providing adult interaction and play riding capability is the Knee Rider toy device made by the Danoco Corporation. The Danoco device includes a stuffed animal head portion resembling a horse's head having a fabric portion attached thereto adapted to rest upon and fit over the upper leg and knee portion of an adult. The fabric portion of the Danoco device has no definite bodY structure associated therewith, but instead, is merely a single or, at most, a few layers of relatively thin fabric material which is sized and cut to cover the upper leg and knee of an adult when opened and placed in a covering relationship thereon. The leg covering portion of the Danoco device has no structural cushioning or padding means associated therewith for supporting a child positioned thereon, and it provides no support for the head and neck portion of the toy associated therewith. Although providing a riding type toy which has a head portion fashioned in the shape of a horse's head and which is placeable on a person's leg, the Danoco device has several shortcomings which limit its desirableness and usefulness as an interactive toy. For example, the leg covering fabric portion of the Danoco device is cut so as to be positionable on a person's leg in only one orientation, namely, with the head of the Danoco toy facing away from the adult upon whose leg the toy rests. This means that a child sitting on the Danoco device will likewise be facing away from the adult attempting to play and interact with the child. Also, importantly, because the Danoco toy has no supportive body structure, the head and neck portions have a tendency to either fall off to one side or to fall forward and slip off of one's knee. In order to maintain the head of the Danoco toy in a substantially upright position during use, a child must constantly grasp and pull rearwardly on the reins attached thereto and must maintain constant tension thereon. This is not true of the present device. Additionally, since the Danoco device has no body structure other than the leg covering fabric material, there is no cushioning or padding means between the child and the person's leg upon which the toy is being used thereby making use of the Danoco toy uncomfortable for both adult and child. For these and other reasons, the above disclosed known prior art devices, including the Danoco device, are not entirely satisfactory as an adult interaction toy and all such devices have enjoyed limited usefulness.

SUMMARY OF THE INVENTION

The present construction overcomes many of the above discussed disadvantages and shortcomings associated with the known prior art including the toy constructions disclosed in the named patents and teaches the construction and operation of a novel fantasy developing adult interaction toy which is fashioned to simulate the appearance of a horse or other animal and is attachable to the upper portion of a person's leg in such a manner that a child may simulate riding the toy animal and interact face-to-face with such person. The present toy has a substantial body structure having upper and lower portions, the entire body portion being made of a compressible, resilient or flexible type material providing ample cushioning between the rider and the wearer. The upper portion of the body structure is shaped generally similar to the back of an animal such as a horse or pony and includes a rear portion extending slightly upwardly relative to a more slender middle section, the middle and rear portions forming a seat or saddle-like portion on which the child sits while straddling the more slender or tapered middle section. The underside portion of the body is likewise made of a compressible, resilient or flexible material or other structure so as to be easily biasable to conform to a person's leg when positioned thereagainst. Adjustable strap means are associated with the underside portion of the body member and are positioned so as to extend around the leg of a person utilizing the present toy to hold, support and securely fasten the toy in proper position on such person's leg. The design of the strap arrangement greatly facilitates the use with which an interacting adult can attach the present toy to one's leg and, in conjunction with the soft, compressible construction of the body member, it greatly enhances the comfort of the user to which the toy is attached.

In addition, the body portion of the present toy is constructed such that the toy may be positioned facing toward or away from the interacting adult. The head and neck portions are preferably formed integral with and extend outwardly from the body member and are likewise preferably made of a similar resilient, compressible type material so as to be somewhat movable and pliable relative to the body portion. In this regard, the present toy may include reins associated with a bridle or harness positioned over the head portion of the toy which may be pulled upon for urging head and neck movement. Also, the present toy may include a pair of optional stirrups extending from opposite sides of the body portion adjacent the seat area for engagement with the child's feet to further simulate the actual riding of a horse and it may include a handle member located near the base of the neck which may be grasped by the child to help hold and stabilize the child in proper position on the toy during use thereof.

In use, a child sitting on the body portion of the present toy may grasp the reins and place his/her feet in the optional stirrups to simulate sitting on and riding the animal. The resilient, yieldable nature of the head and neck portions of the present toy allows a child to manipulate the head and neck to some degree by pulling on the reins. Additionally, the person upon whose leg the present toy is positioned and secured can move their leg in a reciprocating up and down motion so as to simulate the upward and downward movement associated with the gallop of a horse while riding. In the imaginative eyes of a child, some simulated movement of the head and neck, however limited, imparts action, spirit and realism to the present toy comparable to that of a real horse or other animal, particularly when the child and toy are bounced up and down in a gallop type fashion on the adult's leg. This helps to promote a close association and interaction between the child and the person upon whose leg the toy is attached. An adult can therefore use the present toy to meaningfully interact with a very young child or toddler so as to develop the important mental and imaginative skills of the child. This particular combination of features fosters the relationship between adult and child and makes the time spent together using the present toy an enjoyable learning experience helpful to forming the important parent/-child bonds necessary for optimal child development.

Although it is anticipated that the present device will be fashioned after an animal such as a horse or pony, it is recognized that such toy can likewise be easily and conveniently fashioned after other animal characters such as a donkey, zebra, camel, giraffe, swan, turtle, dinosaur, elephant and so forth. Regardless of the animal character selected, the contoured back portion adapted for receiving the posterior of a small child and the resilient and compressible nature of the underside portion of the body enabling the present toy to easily and comfortably conform to the shape of a person's leg when fastened thereto are of special importance to the present invention. Also, of great importance to the present toy is the supportive structure and cushioning means associated with the body portion of the toy. In addition, it is also anticipated that other possible applications of some portions of the present device may likewise include cartoon shaped characters, airplanes, space ships, and other similar forms although such devices may lack the same head and neck portions which typify most animals.

It is therefore a principal object of the present invention to provide a riding toy which may be safely positioned on an adult's leg and which provides optimal interaction between a child riding on the toy and the adult upon whose leg the toy is positioned.

Another object is to provide a riding toy having ample cushioning means for both the child rider and the person upon whose leg the toy is positioned.

Another object is to provide a riding toy which is positionable on an adult's leg in such a position that the child riding the toy is in face-to-face contact with the adult.

Another object is to provide a riding toy which includes adjustable strap means for securing the toy to a person's leg in a safe and comfortable manner.

Another object is to provide a toy construction utilizing a leg strap arrangement which facilitates the ease with which a user can attach the present device to one's leg.

Another object is to provide a toy which is attractive and which includes realistic animal-like features.

Another object is to provide a relatively inexpensive toy construction which is lightweight, durable, and may be supported by the person upon whose leg the toy is positioned without causing undue fatigue and discomfort.

Another object is to teach the construction and operation of a riding type toy having a supportive body structure, the body portion of the present device being made of a compressible type material enabling the underside portion thereof to easily and comfortably conform to the shape of the person's leg upon which it is mounted when fastened thereto.

Another object is to provide a relatively simple toy construction which can be economically produced.

Another object is to provide a toy construction which can be easily and conveniently fashioned after numerous animals forms and other characters and objects.

These and other objects and advantages of the present invention will become apparent to those skilled in the art after considering the following detailed specification in conjunction with the accompanying drawings.

DETAILED DESCRIPTION OF THE INVENTION

Figure 1:
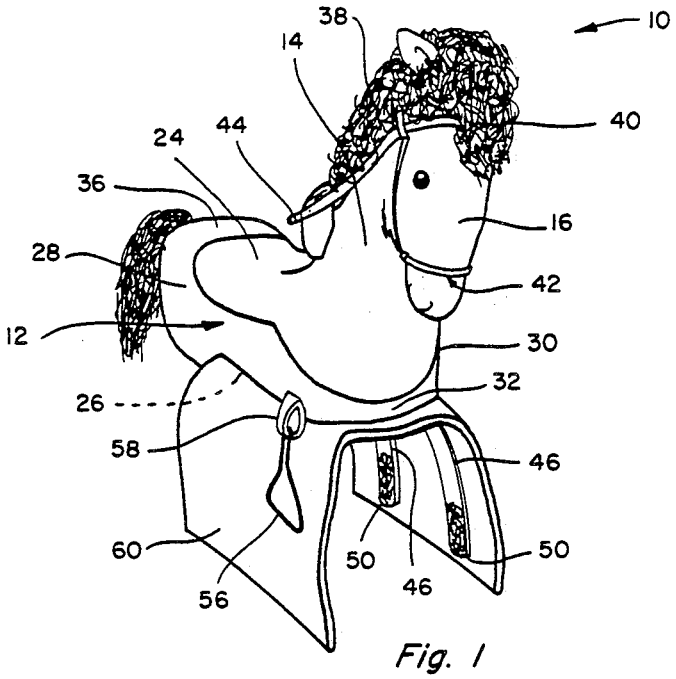
FIG. 1 is a perspective view of a riding toy constructed according to the teachings of the present invention, said toy having optional stirrups and a blanket member associated therewith.
Figure 2:
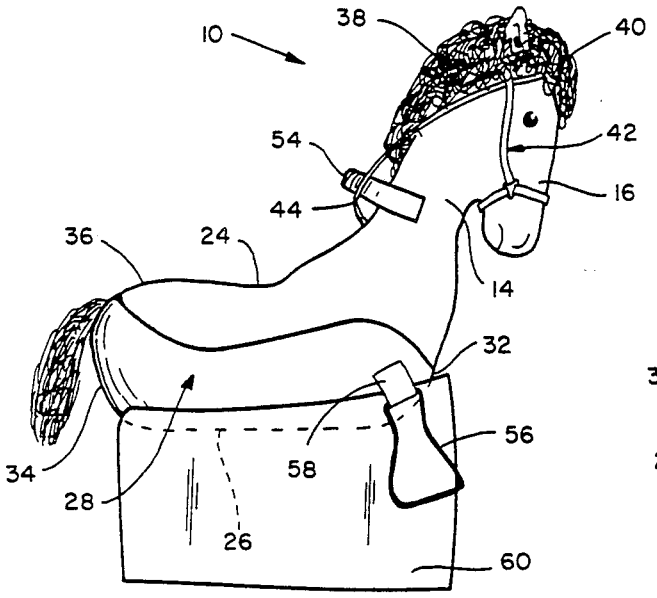
FIG. 2 is a side elevational view of the toy of FIG. 1.
Figure 3:
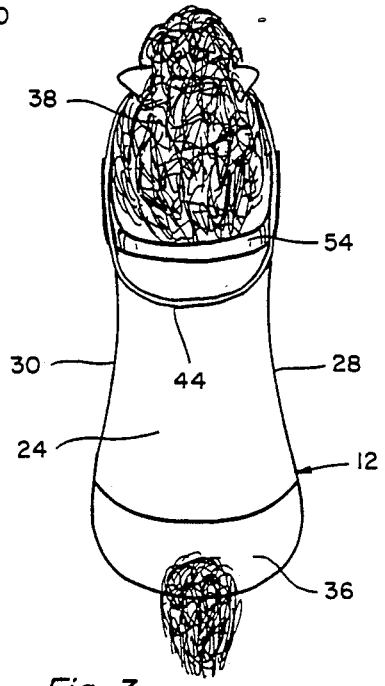
FIG. 3 is a top plan view of the toy of FIG. 1.

Referring to the drawings more particularly by reference numbers wherein like numerals refer to like parts, number 10 in FIG. 1 identifies a preferred embodiment of a riding toy constructed according to the teachings of the present invention. The present toy 10 is a three-dimensional representation of a portion of an animal such as a horse and includes a body portion 12, a neck portion 14, and a head portion 16, the toy 10 being shown in FIG. 5 in operative position on the horizontally extended upper leg portion 18 of an adult or other person 20, with a child 22 seated thereon in riding position. The body, neck and head portions 12, 14 and 16 are preferably integrally formed into a one-piece construction and fashioned so as to resemble the particular shape of the animal desired, although other constructions are likewise recognized such as having each portion 12, 14 and 16 separately formed and operatively attached to each other by suitable means. The body portion 12 is generally elongated in structure and includes spaced apart upper and lower portions 24 and 26 respectively as best shown in FIGS. 1 and 2, spaced apart side portions 28 and 30 as best shown in FIGS. 1 and 3, and spaced apart end portions 32 and 34 as best shown in FIG. 2. The body 12 is solid in nature and is made of or stuffed with a soft, compressible, resilient type material such as a soft foam rubber type material, a fluffed fibrous type material, or any other similar type compressible, resilient and/or flexible material having a soft fabric cloth material covering the entire outer portion thereof. The compressible, resilient type material fills the entire space or cavity formed by and between the peripheral side portions 24–34 defining the body 12 and such material is of sufficient quantity to provide ample cushioning or padding means between the rider of the toy and the person's leg upon which the device rests. This is more clearly illustrated in FIG. 5.

Figure 4:
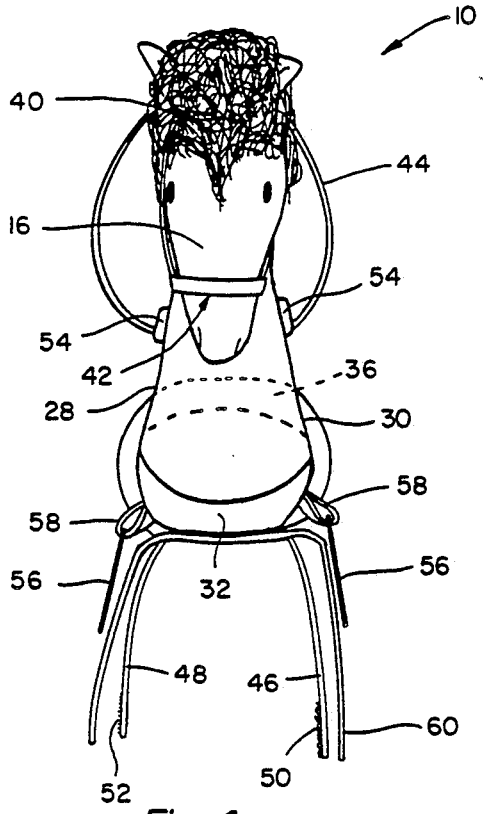
FIG. 4 is a front elevational view of the toy of FIG. 1.
Figure 5:
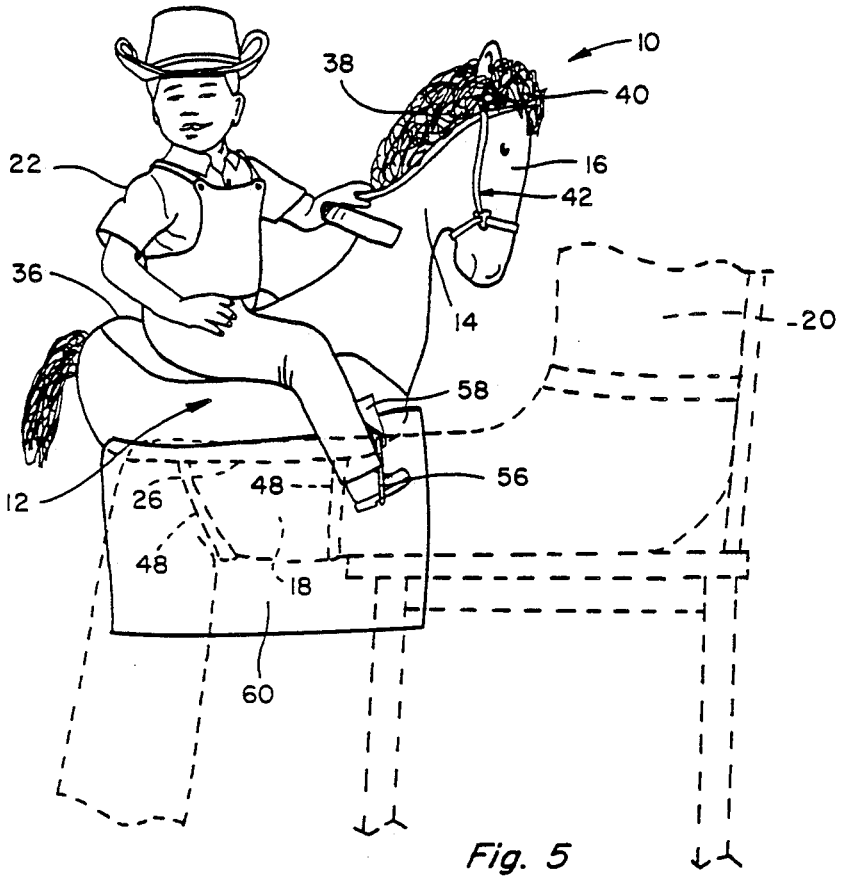
FIG. 5 is a side elevational view similar to FIG. 2 showing the present toy in operative position on the leg of an adult.

The upper portion 24 of the body 12 is shaped generally similar to the back of the particular animal after which the present toy is fashioned such as the horse or pony depicted in FIGS. 1–5. The upper body portion 24 includes a rear portion 36 which extends slightly upwardly relative to a more slender middle section as best shown in FIGS. 1–3, the middle and rear portions of the body 12 forming a seat or saddle like area on which a child may sit. When viewed from the top as best shown in FIG. 3, the upper back portion 24 of the body 12 has a form resembling the hourglass shape of a riding saddle, the spaced apart side portions 28 and 30 each including a concaved portion as best illustrated in FIG. 3. Also, when viewed from the side as best shown in FIG. 2, the front and rear portions of the upper back 24 taper inwardly toward the center of the body 12. This particular body configuration forms the seat or saddle portion adapted to receive the posterior of a child in such a position that the legs of the child straddle the more slender, concaved or tapered portions of the side walls 28 and 30 as shown in FIG. 5.

Since the compressible, resilient type material forming the body portion 12 extends to adjacent the lower portion 26, once positioned in operative position on a person's leg as illustrated in FIG. 5, the underside portion 26 is easily biasable and yieldable inwardly towards the center thereof when attached to a person's leg thereby substantially conforming the lower surface of the body 12 to the shape of the upper leg portion engaged therewith. Also, the underside portion 26 is likewise yieldable due to the weight of the child rider 22 positioned thereon. This yieldability and flexibility is important because this not only provides a certain degree of comfort to the person upon whose leg the toy 10 rests, but it also provides for a better and safer engagement with the leg thereby facilitating a more stable and secure positioning of the present toy 10 upon a user's leg. This greatly reduces the possibility or tendency of the present toy to slip or slide off of one's leg and provides a more stable platform for use as a riding toy. Although it is important that the underside portion 26 of the body 12 be somewhat conformable to the leg of a user, it is also important that the overall thickness of the body 12 be such that the inward compressibility or resiliency of the underside portion 26 will not substantially affect the overall shape of the upper back portion 24. In this regard, the overall thickness of the body 12 as measured from the upper back 24 to the underside portion 26 may vary depending upon the compressibility and resiliency of the material used. Nevertheless, regardless of such material, such thickness should be sufficient to likewise provide comfort for the child rider as well as the person upon whose leg the toy is positioned. Also important to ensuring a stable toy is that there be no relative movement between the compressible material and the fabric covering material comprising the body 12. Lack of relative movement between the body materials is important to maintaining the spaced relationship between the upper and lower body portions 24 and 26 respectively so that the weight and movement of a child sitting on the body 12 does not cause the fabric covering to slip and slide thereby causing a shift in the seat portion relative to the underside 26.

The neck and head portions 14 and 16 are preferably integrally formed with the body 12, the neck 14 extending upwardly and outwardly at an angular orientation from the forward end of the body as shown in FIGS. 1, 2, and 5. The neck 14 is of a modified frusto-conical shape having a somewhat eliptical cross-section which is generally similar to that of an actual pony. Although a one-piece construction is generally preferred, the head and neck portions can be fabricated or formed separately, or such portions can be integrally formed apart from the body portion 12. If this is the case, such head and neck portions can be assembled and connected together to the body 12 so as to appear as illustrated in FIGS. 1–5 using well known techniques. Although it is recognized that the head and neck portions 14 and 16 may be fabricated from a wide variety of suitable materials, it is preferred that the head and neck portions be likewise made of a compressible, resilient type material similar to that used to fabricate the body 12, particularly, if such portions are formed intergral therewith. This enables the head and neck portions to be somewhat movable and pliable relative to the body 12 when a pulling or pushing force is exerted thereagainst. The resilient, yieldable nature of the head and neck portions therefore allows a child to manipulate the head and neck to some degree by pulling or pushing thereagainst, for example, by pulling on the reins 44 as will be hereinafter explained. Since the neck 14 is yieldable when any external force applied thereagainst is removed, the elasticity associated therewith will cause the neck 14 to return to and assume its predetermined at rest position as illustrated in FIGS. 1, 2, and 5. Although some degree of manipulation of the neck and head portions 14 and 16 to simulate the movement thereof is optional, such simulated movement, however limited, imparts additional action and realism to the present toy comparable to that associated with the actual riding of a real horse or other animal.

In addition, the various parts of the present toy 10 can be decorated, colored and/or embroidered to produce as much realism as desired. For example, the head portion 16 may include a mane 38 fabricated of fibrous strands of material, a forelock 40 formed from a similar type material, and other appropriate facial features depending upon the particular animal form after which the present device is fashioned. Additionally, a bridle or harness assembly 42 may be positioned over the head portion 16 as best shown in FIGS. 1–5 to impart additional realism to the toy 10. The bridle assembly 42 includes suitable straps and head stall and reins 44 suitably attached thereto. A user, by manipulating the reins 44, can impart some movement to the head and neck in opposition to the natural resiliency or yieldability of the material forming such head and neck portions. The entire bridle assembly 42 including the reins 44 can be fabricated from known materials such as leather, canvas, fabric, plastic or other natural and/or synthetic materials. The exertion of a pulling force on the reins 44 controls the movement of the head and neck portions. In this regard, the relative elasticity or yieldability of the members 14 and 16 based upon the particular type of compressible, resilient type materials utilized to form the same will have a bearing on how much head and neck movement will be produced relative to the body 12. Once some head and neck movement is achieved, the operator need only let up on the reins 44 for the neck and head portions to return to their normal, at rest positions. Although the bridle assembly 42 and reins 44 are optional, their use is preferred to increase realism both as to appearance and as to operation.

One or more selectively engageable, adjustable strap means such as the respective pairs of strap members 46 and 48 are positioned adjacent the underside portion of the body member 12 for securely fastening the present toy 10 to the upper leg portion of an adult. One end portion of each of the strap members 46 and 48 can be fixedly attached by suitable means to either the underside portion 26 or the opposite side portions 28 and 30 of the body 12, as desired. Each respective pair of strap members 46 and 48 are also of sufficient length to wrap around or encircle an adult's leg in overlapping fashion and each such pair includes cooperatively engageable means associated with the respective free end portions thereof, such cooperatively engageable means enabling the strap members 46 and 48 to be adjustable to accommodate attachment to leg portions having different circumferential dimensions.

It is recognized that a wide variety of cooperatively engageable means may be utilized in association with the connectable end portions of the strap members 46 and 48. For example, as illustrated in FIGS. 1 and 4, such cooperatively engageable means may include synthetic materials which adhere when pressed together such as the Velcro fastener strips 50 and 52 (FIG. 4) applied adjacent to each free end portion of the members 46 and 48 in position so as to overlap each other to make the necessary connection. The overlapping of the connectable end portions 50 and 52 of the strap member 46 and 48 also will afford adjustability in attaching the toy 10 to the leg of a particular adult. Alternatively, the free end portion of one of the strap members 46 and 48 could be provided with a buckle and hook arrangement adapted to engage a desired one of a plurality of spaced eyelets located adjacent the free end portion of the other of the strap members 46 and 48. In addition, it is further recognized that the cooperatively engageable means 50 and 52 may include a plurality of snap fasteners or a button arrangement. Other known fastener means affording adjustability to the strap members 46 and 48 could likewise be utilized. It is also recognized and anticipated that, instead of utilizing respective pairs of cooperatively engageable strap members such as the members 46 and 48, such pairs of strap members may be respectively replaced by a single strap member having one end portion fixedly attached adjacent one side of the body portion 12 and having its free end portion cooperatively engageable with corresponding means associated with the opposite side thereof. In any event, the strap or attachment means utilized with the present toy 10 should be made as easy as possible to position and secure in a snug fashion around the upper leg portion of an adult such that, when engaged therewith, the strap or other attachment means provides sufficient tension to maintain the toy 10 in a proper, upright orientation during use.

It is also important that the attachment means be adjustable in some fashion as previously explained and that such means provide sufficient force to prevent rotation about or disengagement from the leg of the person to which the toy 10 is attached. This is particularly important when one moves their leg in a reciprocating up and down motion to simulate the upward and downward movement associated with the gallop of a horse while riding. In this regard, care should be taken in selecting the material out of which the strap members 46 and 48 are fabricated to ensure that such material does not cause friction burns, chaffing, and other irritations and discomforts to the adult person using the present device since the strap members will move against and exert a force or pressure on the user's leg during use with a child. The selection of the strap material in conjunction with the compressible construction of the body member should afford comfort to the adult to which the toy is attached.

The present toy 10 may also optionally included a handle member 54 located near the base of the neck portion 14 as best shown in FIGS. 2 and 3. The handle 54 is a somewhat curved, cylindrical sectional member fixedly attached at both opposite ends thereof to the respective opposite sides of the neck 14 by any suitable means. The handle member 54 is sized so as to be comfortably and securely held in one or both hands by a small child for steadying and stabilizing the child in a proper position while sitting on the toy 10. This is particularly important if the child is bounced up and down in a gallop-type fashion on an adult's leg. Also, the toy 10 may include a pair of optional stirrups 56 extending from opposite sides of the body 12 adjacent the seat area for engagement with a child's feet as illustrated in FIG. 5. The stirrups 56 may be fabricated from any suitable material such as fabric, metal and/or plastic-type material and each should be of sufficient size to receive a child's foot. The stirrups 56 may be attached to the body 12 by any suitable means such as looping one end portion of the stirrup 56 through a ring or loop member 58 which is fixedly secured to the body as best illustrated in FIGS. 1 and 2. Still further, the toy 10 may likewise include an optional saddle blanket 60 to further impart realism to the toy 10. The saddle blanket 60 may be attached by suitable means to the underside portion 26 of the body 12 as shown in FIGS. 1 and 4. When in position on a user's leg, the saddle blanket 60 overlays and overhangs the opposite side portions of the leg and completely conceals the strap members 46 and 48 from view. Additionally, for educational purposes or otherwise, the saddle blanket 60 may also include an arrangement of alpha-numeric figures, characters, designs or the like on the outside thereof.

It is also important to note that body portion 12 of the present toy 10 is specifically constructed such that the toy may be positioned on a person's leg in one of two possible orientations, namely, with the head portion 16 facing either toward or away from the interacting adult. This is true because the body portion 12 has no interfering structure which limits the manner in which it is positioned upon a user's leg. This therefore enables a user to position the toy 10 so that the child seated thereon will be in face-to-face contact with the adult user, if desired. This feature is likewise important because it promotes and fosters a close relationship and interaction between the child, the toy 10, and the interacting adult upon whose leg the toy is attached, all of which helps to form the important parent/child bonds necessary from optimal child development.

To use the present toy 10, an adult user merely positions and secures the present toy 10 to his/her leg in one of the two possible orientations by securely fastening the strap members 46 and 48 therearound as illustrated in FIG. 5. A child sitting on the body portion 12 may then grasp the reins 44 and/or the handle member 54 and may thereafter place his/her feet in the optional stirrups 56 to simulate both sitting on and riding the toy 10. The rocking back and forth of the child on the toy 10 as well as bouncing the child and toy up and down on one's leg imparts realism to the riding experience. The yieldable nature of the neck and head portion 14 and 16 likewise enable a child to manipulate the head and neck to some degree by exerting a pulling force on the reins 44 thereby adding still further realism to the riding experience.

As previously explained, the various portions of the present toy 10 are preferably constructed of a soft, compressible, resilient type material such as foam rubber, a fluffed fibrous material, or any other such compressible and/or resilient material having a soft fabric cloth material covering the entire outer portion thereof. It is also anticipated that the present toy can be made from a wide variety of alternative materials such as a soft formable or moldable vinyl or plastic material or it may be made so as to be inflatable to provide the required compressibility and resiliency as previously explained. Likewise, it is anticipated that the present toy could be designed so as to proportionately match the confirmation of a wide variety of animals and other characters including those previously mentioned above. Because there are many possibilities for design in material usage that can be used in association with the present invention, those chosen and described above with reference to the preferred embodiment disclosed herein are not intended to limit the present invention in any substantial manner.

Thus there has been shown and described a novel riding toy construction which provides optimal interaction between child and adult, which construction fulfills all of the objects and advantages sought therefor. Many changes, modifications, variations and other uses and applications of the present invention will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A child's riding toy for attaching to the upper leg portion of a person comprising a three dimensional representation of a portion of an animal body upon which a child can be seated, said three dimensional representation including a body member having opposed front and rear end portions, a middle portion located therebetween and spaced apart upper and lower surfaces, said body member being constructed of a compressible type material and including means between said spaced apart upper and lower surfaces to provide cushioning for a child seated on said upper body surface, the upper surface of said body member having an area adjacent said rear end portion adapted to receive the posterior of a child seated thereon with the child's legs being in straddling relationship to said middle portion, said upper surface sitting area being wider than said middle portion, the lower surface of said body member being substantially planar in its free state and conformable to the upper leg portion of the person upon which it is positioned when attached thereto and biased thereagainst, said riding toy being positionable on a person's leg with either said front end or said rear end facing said person, and means associated with said body member for attaching said toy to the upper leg portion of said person.

2. The riding toy defined in claim 1 wherein said means for attaching said toy to the upper leg portion of a person includes strap means extending from adjacent the lower surface thereof.

3. The riding toy defined in claim 2 wherein said strap means includes at least two flexible strap members positioned in opposed relationship so as to encircle the upper leg portion of a person when fastened together, each of said strap members having one end portion attached to said body member and having an opposite free end, and cooperatively engagable means associated with the respective free end portions of said strap members for fastening the same together in overlapping fashion.

4. The riding toy defined in claim 3 wherein said cooperatively engagable means includes synthetic materials which adhere when pressed together.

5. The riding toy defined in claim 1 wherein said body member includes handle means fixedly attached thereto for grasping by a child seated thereon.

6. The riding toy defined in claim 1 wherein said compressible type material includes soft fabric material.

7. A riding toy for attaching to the upper leg portion of a person, said toy comprising a body member fashioned to simulate the appearance of an animal, said body member having spaced apart top and bottom portions separated by oppositely facing concave side portions located therebetween, said body member being formed of a material enabling said bottom portion to at least partially conform to the contour of the top surface of the upper leg portion of the person upon which the toy is positioned when attached thereto and biased thereagainst, said top portion forming a saddle like shape for receiving the posterior of a chile positioned thereon with the child's legs being positionable on either side of said body member with one leg adjacent each of said concave side portions, said top portion and said concave side portions being spacedly related and located above the uppermost surface of a person's leg when said toy is located thereupon and a child is positioned on said top portion, said body member including compressible means between said spaced apart top and bottom portions to provide cushioning for both a child positioned on said saddle like portion and for the person on whose leg the toy is positioned, and fastening means extending from said body member for attaching said toy to said upper leg portion.

8. The riding toy defined in claim 7 wherein said toy further includes a head and neck portion extending from one end of said body member, said toy being fashioned to have the appearance of a horse.

9. The riding toy defined in claim 8 including reins attached to said head portion.

10. The riding toy defined in claim 8 including stirrups located on each opposite side of said saddle like portion for accommodating the feet of a child when positioned thereon.

11. The riding toy defined in claim 7 wherein said material includes a compressible, resilient type material.

12. The riding toy defined in claim 7 wherein said fastening means includes strap means with adjustment means for adjusting the length thereof.

13. A horse-like riding toy attachable to the upper leg of a person comprising a body portion, a neck portion attached to one end of said body portion and a head portion, said body portion having spaced apart upper and lower surfaces and being formed of a compressible material, said upper surface having a saddle like shape for receiving the posterior of a child located at the end opposite said neck and head portions, said lower surface being substantially planar in its unbiased free state and conformable to the shape of the top surface of the upper leg of the person upon which the toy is positioned when attached thereto and biased thereagainst, said toy being positionable on a person's leg with said head portion facing toward or away from said person, means located between the upper and lower surfaces of said body portion for providing cushioning to a child seated thereon and for maintaining the spaced relationship between said upper and lower surfaces, and strap means attached to said body portion adjacent the lower surface thereof for fastening said toy to the upper leg of a person and biasing the lower surface thereagainst, said strap means being of sufficient length to encircle the upper leg when said toy is positioned thereon.

14. The horse-like toy defined in claim 13 including a blanket member positioned adjacent the lower surface of said body portion, said blanket member having portions thereof which overhang the respective opposite sides of the upper leg of the person upon which it is positioned.

15. The horse-like toy defined in claim 13 wherein said strap means include means for adjusting the length thereof.

16. The horse-like toy defined in claim 13 including handle means attached to said neck portion in a location enabling a child seated thereon to easily grasp the same.

17. A child's riding toy for attaching to the upper leg of a person comprising a three dimensional representation of a portion of an animal upon which a child can ride, said representation being constructed of a compressible material having a cloth like outer covering and including a body member having spaced opposed end portions, spaced opposed side portions and spaced opposed upper and lower surfaces, means positioned between the opposed side and end portions and the upper and lower surfaces of said body member to provide cushioning for a child seated thereon, the upper surface of said body member having a saddle like shape associated therewith for receiving a child's posterior, the lower surface of said body member having a substantially planar shape which is conformable to the upper portion of the leg of a person when said toy is attached thereto and biased thereagainst, said upper surface and said spaced opposed side portions being located above the leg on which the toy is attached and biased against when a child is seated on said toy, a head portion extending from one end portion of said body member including reins attached thereto, said toy being positionable on a person's leg with said head portion facing toward or away from said person, stirrups positioned on opposed sides of said saddle like portion for accommodating the feet of a child seated thereon, and adjustable strap means extending from the opposite sides of said body member for attaching said toy to the upper leg of a person.

* * * * *